US008091537B2

(12) United States Patent
Manning et al.

(10) Patent No.: US 8,091,537 B2
(45) Date of Patent: Jan. 10, 2012

(54) APPARATUS AND METHOD FOR ENGINE HEAD

(76) Inventors: Kelsey Manning, Preston, ID (US); James Rex Larsen, Preston, ID (US)

( * ) Notice: Subject to any disclaimer, the term of this patent is extended or adjusted under 35 U.S.C. 154(b) by 499 days.

(21) Appl. No.: 12/272,512

(22) Filed: Nov. 17, 2008

(65) Prior Publication Data

US 2009/0126675 A1 May 21, 2009

Related U.S. Application Data

(60) Provisional application No. 60/989,401, filed on Nov. 20, 2007.

(51) Int. Cl.
*F02P 23/00* (2006.01)

(52) U.S. Cl. ..... 123/661; 123/659; 123/663; 123/664; 123/669

(58) Field of Classification Search ..... 123/193.5, 123/193.1, 661, 669, 663, 671, 664, 659, 123/657
See application file for complete search history.

(56) References Cited

U.S. PATENT DOCUMENTS

| | | | | | |
|---|---|---|---|---|---|
| 2,688,320 | A * | 9/1954 | Czarnocki | 123/661 |
| 4,041,923 | A * | 8/1977 | Konishi et al. | 123/661 |
| 4,162,661 | A * | 7/1979 | Nakanishi et al. | 123/307 |
| 4,280,459 | A * | 7/1981 | Nakanishi et al. | 123/307 |
| 4,289,099 | A * | 9/1981 | Nakanishi et al. | 123/307 |
| 4,389,986 | A * | 6/1983 | Tanasawa | 123/298 |
| 4,467,752 | A * | 8/1984 | Yunick | 123/193.6 |
| 4,686,948 | A * | 8/1987 | Smith et al. | 123/193.5 |
| 4,976,248 | A * | 12/1990 | Rowe | 123/659 |
| 5,103,784 | A * | 4/1992 | Evans | 123/279 |
| 5,492,092 | A * | 2/1996 | Benson | 123/193.5 |
| 5,809,968 | A * | 9/1998 | Tsuchida | 123/432 |
| 6,237,579 | B1 * | 5/2001 | Singh | 123/661 |

* cited by examiner

*Primary Examiner* — Noah Kamen
*Assistant Examiner* — Long T Tran
(74) *Attorney, Agent, or Firm* — Kunzler Needham Massey & Thorpe

(57) ABSTRACT

An apparatus and method for improving performance in an internal combustion engine includes texturing on an inner surface of at least a portion of an engine head. The texturing may include elongated raised portions extending in one or more directions that may aid in controlling and directing pre-combustion and/or combustion gases in a combustion chamber for a more unified combustion. The result is improved power and/or efficiency.

16 Claims, 9 Drawing Sheets

APPARATUS AND METHOD FOR ENGINE HEAD

CROSS-REFERENCES TO RELATED APPLICATIONS

This application claims priority to U.S. Provisional Patent Application No. 60/989,401 entitled APPARATUS AND METHOD FOR ENGINE HEAD and filed on Nov. 20, 2007 for Kelsey Manning and James Rex Larsen, which is incorporated herein by reference.

BACKGROUND OF THE INVENTION

1. Field of the Invention

This invention generally relates to engine heads and more particularly to inner surfaces of engine heads that provide improved performance.

2. Description of the Related Art

Many workers in the art have attempted to improve performance by changing shapes of combustion chambers and by attempting to channel flow within the combustion chambers. Of particular benefit is the evolution in shape of combustion heads from a generally hemispherical shape to a configuration that includes a squish band that provides a small clearance between the engine head and the piston in a radially outer region of the head when the piston is in a top dead center (TDC) position. A radially inner region may have a hemispherical and/or bathtub shape. This combination of squish band and hemispherical and/or bathtub shape has increased the turbulence that occurs during the compression part of the combustion cycle. The results include improved efficiency and reduced pinging.

Others have experimented with different shapes within the combustion chamber. Some have implemented these different shapes by changing the contour on the piston crown or by placing channels in the piston crown. In U.S. Pat. No. 6,237,579, Singh teaches placing channels in the inner surface of the engine head. Singh does so for the purpose of improving turbulence in the combustion chamber.

Cylindrical engine heads of the past have typically been formed on a lathe or cast. Some workers have actually polished the inner surfaces of engine heads to improve flow along these surfaces. Even those who have placed channels in the combustion chamber have attempted to keep the surfaces smooth.

A rate of flow that becomes turbulent during the compression portion of the combustion cycle is beneficial because it places more of the combustible gas in contact with the spark and flame front more quickly. Since it is difficult to control the propagation of the flame front, a more turbulent mixing brings the combustible gases to the flame front. In this way, more of the fuel and air gases are ignited at once, and more power output and more complete combustion occurs. Keeping the fuel atomized in the fuel air mixture has also been a concern, and increased turbulence has been seen as aiding in keeping more of the fuel in an atomized state. Even with the progress that has been made, the amount of control and direction of combustion in a combustion chamber is still limited.

SUMMARY OF THE INVENTION

From the foregoing discussion, it should be apparent that a need exists for an apparatus, system, and method that further aids in controlling and directing combustion in internal combustion engines. Beneficially, such an apparatus, system, and method would guide gases within a combustion chamber and cause combustion to occur more uniformly throughout the combustion chamber.

The present invention has been developed in response to the present state of the art, and in particular, in response to the problems and needs in the art that have not yet been fully solved by currently available knowledge and information. Accordingly, the present invention has been developed to provide an apparatus and method for controlling and directing pre-combustion and/or combustion gases that overcome many or all of the above-discussed shortcomings in the art.

The apparatus, in one embodiment, is configured to control and direct pre-combustion and/or combustion gases in an internal combustion engine. In a simple form, an engine head may include an outer surface and an oppositely facing inner surface adapted for facing an inside of a piston cylinder of an internal combustion engine. A contour on the inner surface may include one or more of a squish step surface, a squish band surface, and a combustion chamber surface. In addition to the contour, the engine head may include elongated raised portions on at least one of the squish step surface, the squish band surface, and the combustion chamber surface.

The apparatus is further configured, in one embodiment, such that the elongated raised portions may include a first set of ribs extending longitudinally in a first direction and/or a second set of ribs extending longitudinally in a second direction transverse to the first direction.

In a further embodiment, an internal combustion engine head may be configured to include a sealing surface at a radially outer extent. A squish band may be located radially inward from the sealing surface. A combustion chamber surface may be located radially inward from the squish band, and a plug opening radially inward from the squish band. At least a portion of the squish band and the combustion chamber surface may be textured.

In one embodiment, the texture may include radial ridges extending generally radially. In another embodiment, the texture may additionally include cross-wise ridges extending transverse to the radial ridges.

In one embodiment, a squish step between the sealing surface and the squish band may have a radially inwardly facing surface with circumferentially spaced axial elongated raised portions extending axially from the squish band.

In another embodiment, the sealing surface, squish step, squish band, and combustion chamber surface can be formed by an end mill or other tool such that boundaries between the sealing surface, squish step, squish band, and combustion chamber surface are rounded.

A method of the present invention is also presented for improving performance in internal combustion engines. The method in the disclosed embodiments substantially includes the steps necessary to carry out the functions presented above with respect to the operation of the described apparatus and system. In one embodiment, the method includes improving power and efficiency in a combustion process of an internal combustion engine by causing order of at least one of flow and combustion of gases in a combustion chamber. In an embodiment of the invention, the step of causing order also may include forming a multitude of streamlets along an inner surface of an engine head. These streamlets may be radial or axial, or have a combination of radial and axial components. The streamlets may be formed during combustion and/or intake, and the streamlets may have turbulent flow.

Another embodiment of the method may include improving power and efficiency in a combustion process of an internal combustion engine by forming a boundary layer in a flow gases at an engine head in a combustion cylinder by a textured inner surface of the engine head.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
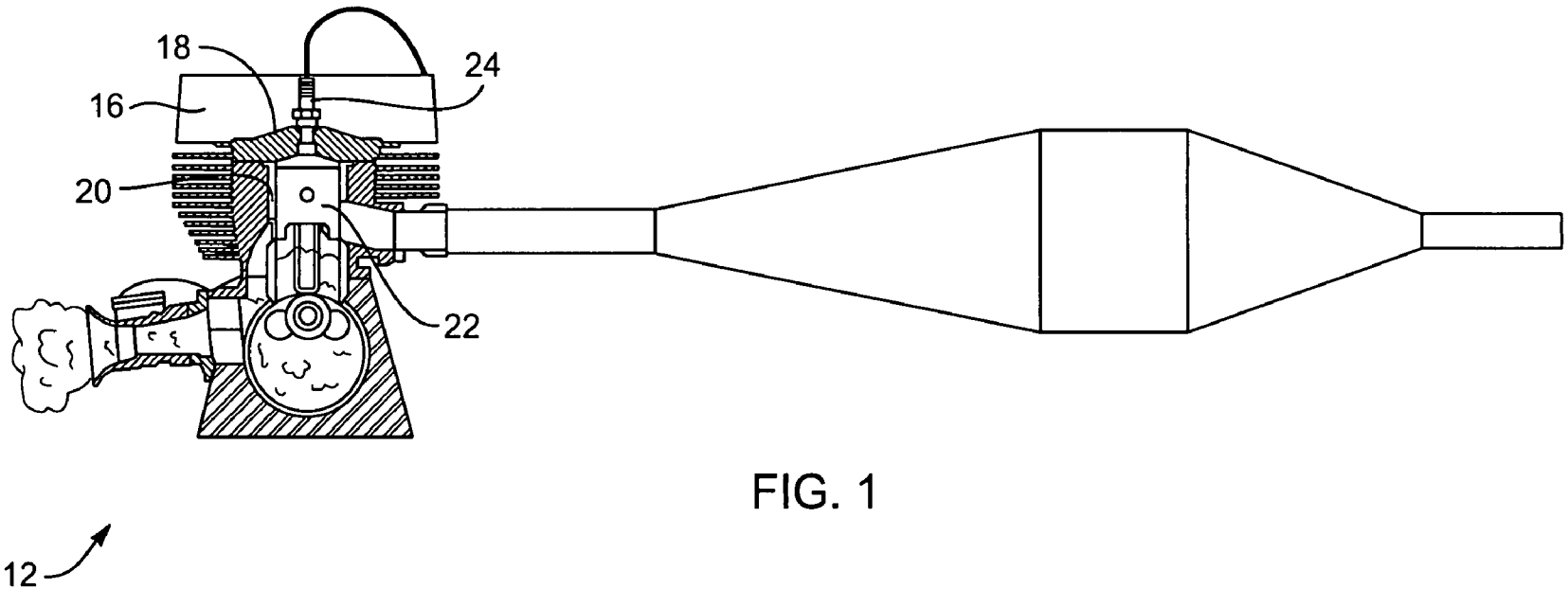
FIG. 1 is a diagrammatic partial sectional view of a two cycle internal combustion engine.

As discussed above, embodiments of the present invention relate generally to engine heads, and more specifically to textures on inner surfaces of engine heads. By way of example, FIG. 1 depicts a partial sectional view of an air cooled two cycle engine 12 having an engine head 14 including a head cover 16 and a head insert 18 held in place by the head cover 16 on a cylinder 20. The engine 12 shows a piston 22 at top dead center (TDC), and a spark plug 24 supported in the head insert 18. It is to be understood that the texturing and related principles of embodiments of the present invention are applicable to four cycle engines as well as to two cycle engines, and that the engines may be air cooled or water cooled without limitation.

An engine head insert 18 like that shown in FIG. 1 may be formed separately from the cover or an engine head may be an integral head that includes an inner surface that forms part of a combustion chamber of the engine. Although the inner surface is described herein as part of the engine head insert 18, it is to be understood that the same principles may be applied to an integral engine head that includes a portion of the inner surface of the combustion chamber without limitation. The principles and methods of the present invention may be applied to internal combustion engines and their combustion chambers no matter what their configurations may include. For example, the teachings of the present invention may be applied to four cycle internal combustion engines that have no squish step and/or squish band, and to internal combustion chambers of any shape or configuration.

Figure 2A:
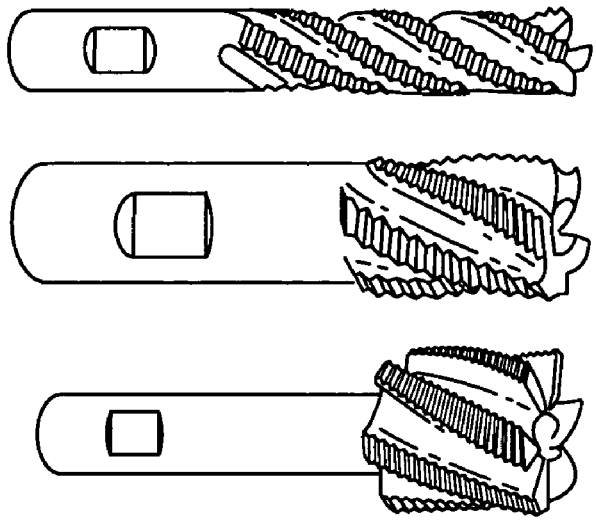
FIGS. 2A and 2B are perspective side views of a variety of end mill tools.
Figure 2B:
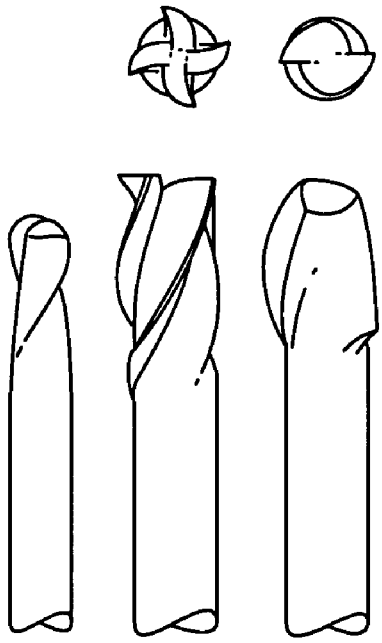

Principles of the present invention may be implemented on engine head inserts or other surfaces forming part of a combustion chamber of any internal combustion engine. However, by way of example, engine head inserts may be formed in any of a variety of ways including casting, machining on a lathe, or machining on a milling machine. When using milling machines, any of a variety of milling tools may be utilized for removal of material from a billet of stock material. Typically an initial planning step is undertaken since the billet is not usually exactly squared on the end. Then a roughing step is taken in which the piece is brought to within fifty to sixty thousandths inch of its final form, for example. The piece may then be finished utilizing any of a variety of end mills like those shown in FIGS. 2A-2B. FIG. 2A shows three flat end or square end mills 26 having four or six flutes each. FIG. 2B shows a split end mill 28 and a round headed end mill 30. Any of these tools may be utilized to implement the principles shown and described with regard to the embodiments of the present invention. However, the embodiments shown and described with regard to FIGS. 3-14 were formed using a Cincinnati 500, a Takumi Seiki, or a Cincinnati, Sabre 750

(not shown). The end mill that was utilized is a one-half inch square end mill manufactured by McMaster-Carr.

Two additional steps are needed for completion of the head insert. After finishing the contour with a desired surface on the underside of the piece, a drilling and threading process is undertaken. Finally, the head insert is turned over and the outer surface is machined.

Figure 3:
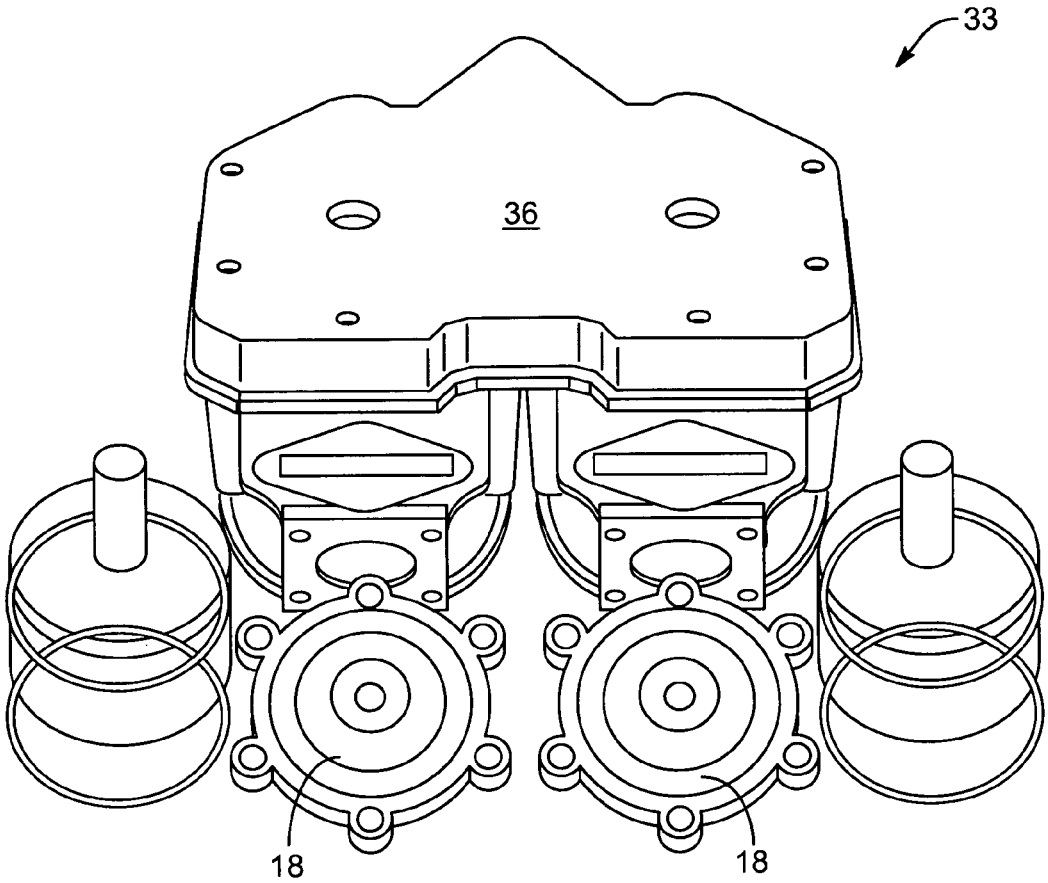
FIG. 3 is a perspective view of an engine kit including a head cover and two engine head inserts.

FIG. 3 shows an example of an engine kit 33 that includes a head cover 36 and head inserts 18. The head inserts 18 may be included in a kit having greater or fewer pieces than shown in FIG. 3 for retrofitting to an existing engine. Alternatively, the engine head inserts 18 may be included at the time of manufacture, or the texturing described below may be implemented on inner surfaces of integral engine heads whether for two cycle or four cycle internal combustion engines. Even though the description below focuses on engine head inserts, the same texturing and related benefits are applicable to inner surfaces that are on integral engine heads.

Figure 4:
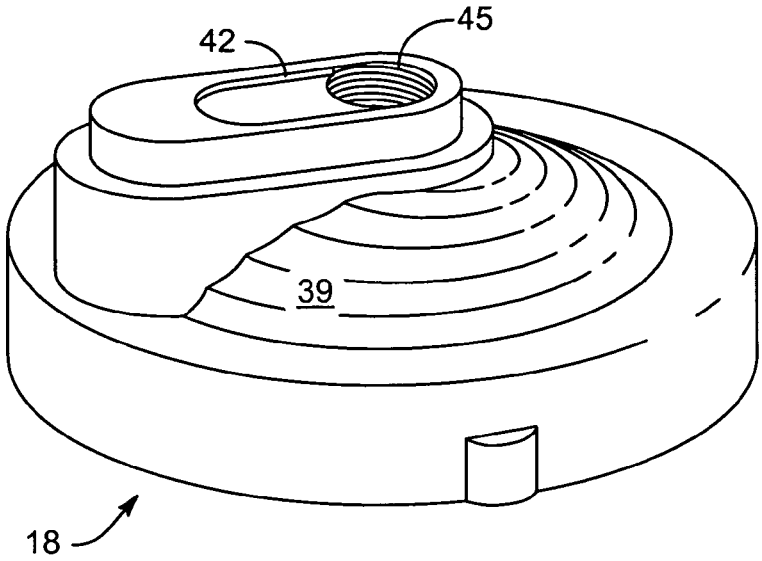
FIG. 4 is a top perspective view illustrating one embodiment of an engine head insert according to an embodiment of the present invention.

FIG. 4 shows a perspective top view of an engine head insert 18 formed of aluminum. However, the engine head insert 18 may be formed of steel or any other suitable material including alloy materials. As shown, the head insert has an outer surface 39 that is to be engaged by the engine head cover during use. The outer surface has a raised spark plug supporting block 42 having a spark plug opening 45 at a radially inner end of the spark plug block 42. There is room for another spark plug opening (not shown) at a radially outer end. This other opening could be angled radially inwardly and downward. Generally, multiple spark plugs could be supported in the head or head insert 18.

Figure 5:
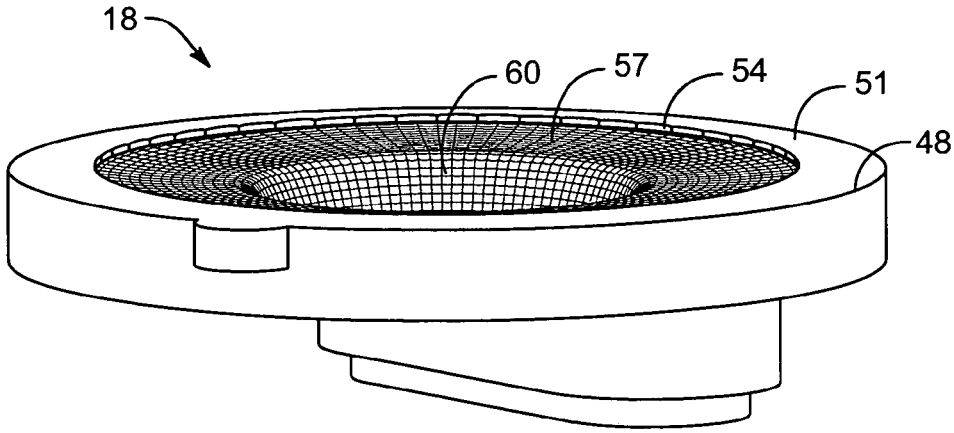
FIG. 5 is a side perspective view further illustrating the engine head insert of FIG. 4.

FIG. 5 shows a side perspective view of the head insert 18 being turned over relative to the view shown in FIG. 4. Thus, a contour of an inner surface of the head insert 18 is visible. A radially outer flat region extends from an outer edge 48 and forms a sealing surface 51 that extends radially inward to a squish step 54. The squish step extends axially to a squish band 57 on which a radially extending texture or pattern is shown in FIG. 5. The squish band 57 has a relatively gradual incline extending axially and radially inward to a more greatly recessed combustion chamber 60 portion of the contour that also has a texture or pattern similar to the texture or pattern on the squish band 57.

Figure 6:
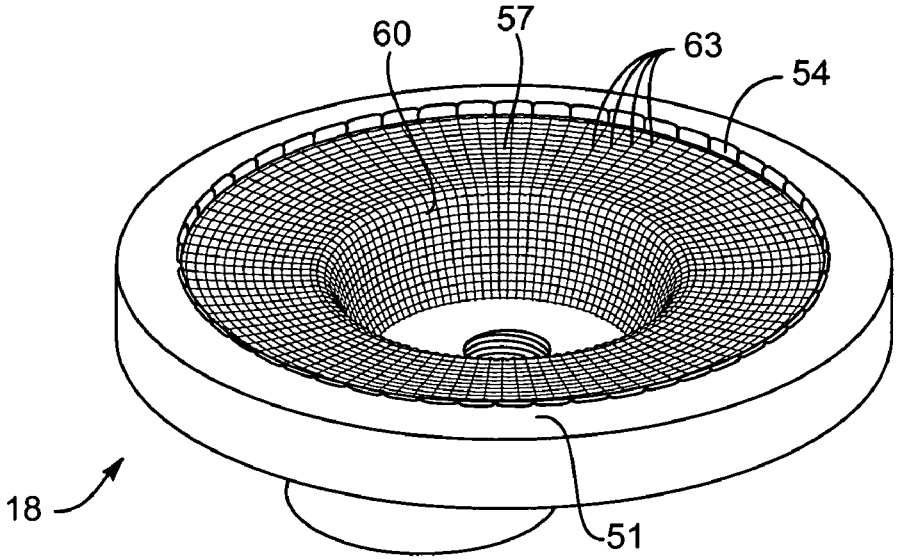
FIGS. 6-9 are a variety of bottom perspective views further illustrating the engine head insert of FIGS. 4 and 5.
Figure 7:
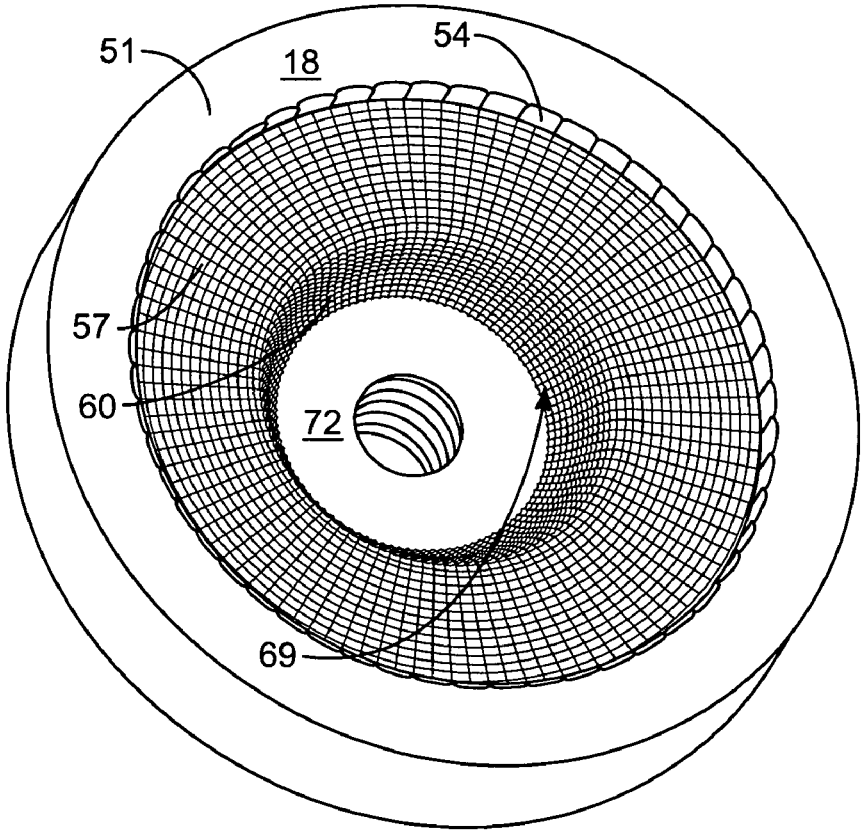
Figure 8:
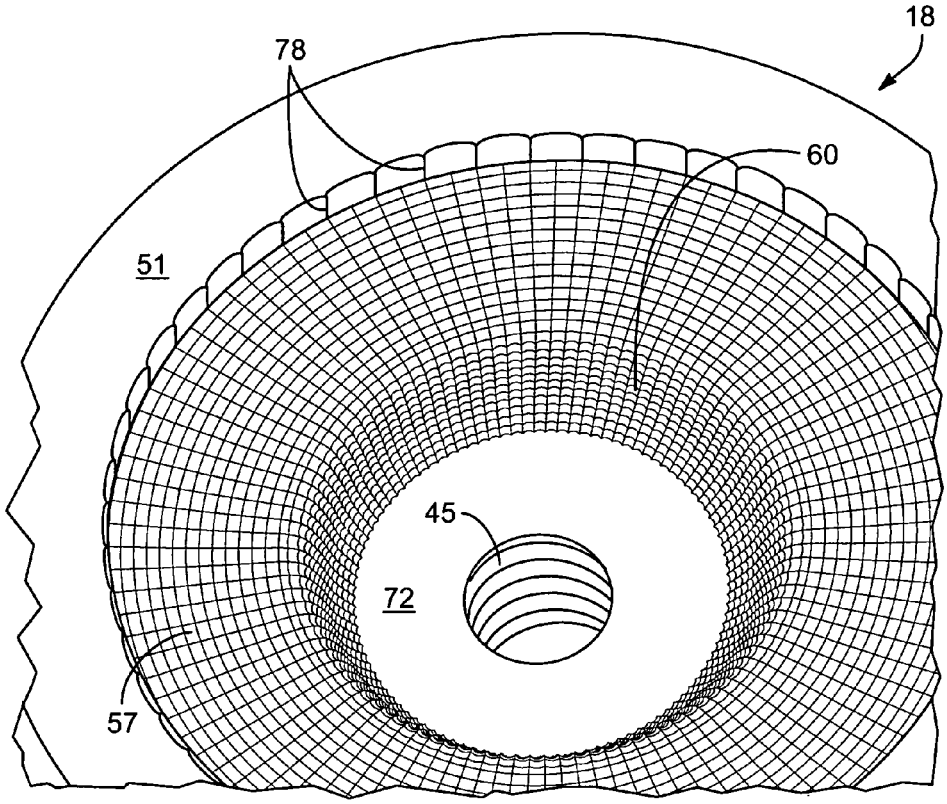
Figure 9:
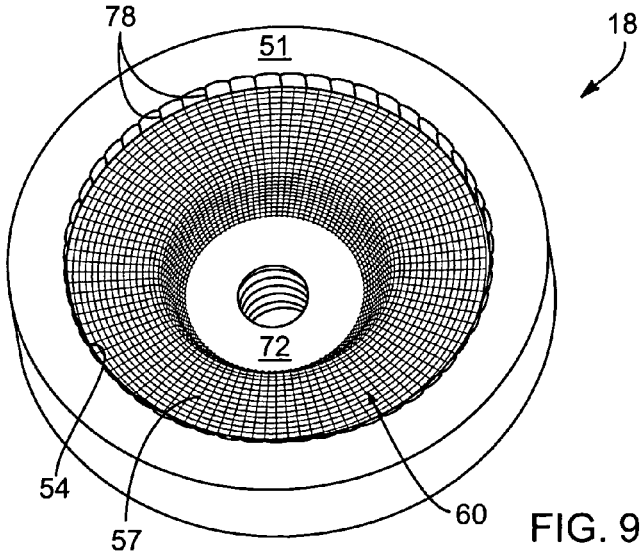

FIGS. 6-9 are perspective bottom views showing a variety of angles that emphasize the texture and patterns. For example, FIG. 6 is a perspective bottom view that shows a pattern of radially extending ridges or elongated raised portions at 63 and 66 on the squish band 57. FIG. 7 shows how this radially extending pattern extends into the combustion chamber 60, as shown at 69. FIG. 7 also shows a swirled pattern on a flat inner region 72 of the combustion chamber 60. As illustrated in FIGS. 8 and 9, the radially extending pattern of elongated raised portions extends over the entire squish band 57 and the portion of the combustion chamber between the squish band 57 and the flat portion 72, which surrounds the spark plug opening 45. FIGS. 8 and 9 also show a pattern of raised portions on the squish step 54 at 78.

Figure 10:
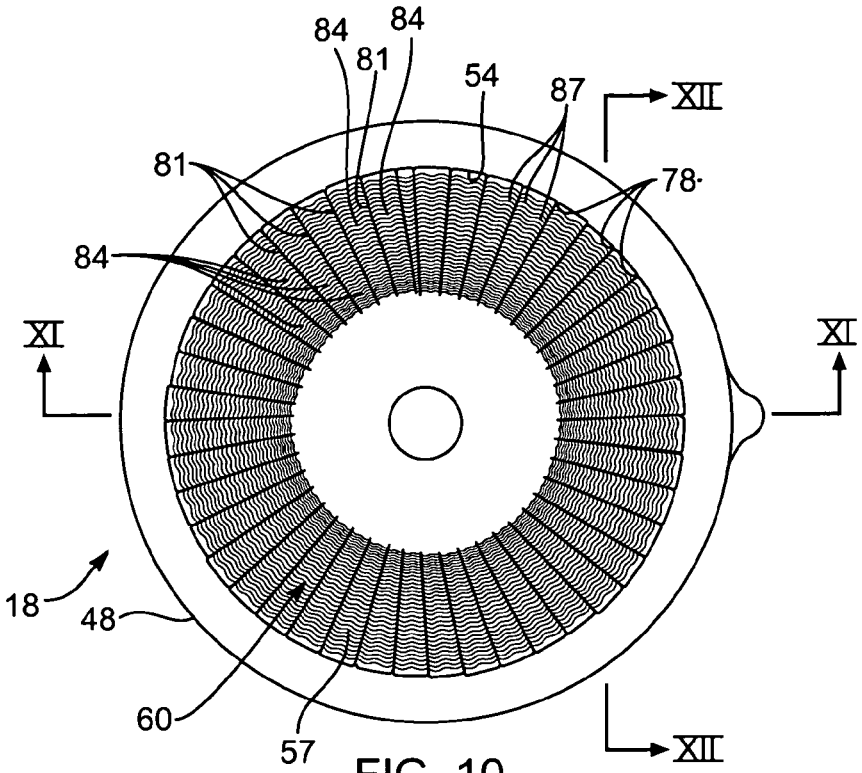
FIG. 10 is a bottom view further illustrating the engine head insert of FIGS. 4-9.

FIG. 10 is a bottom view having more detail of the patterns shown in FIGS. 5-9. As shown in FIG. 10, the squish step 54 may have a pattern of radially raised portions 78 extending axially and spaced generally circumferentially along the squish step 54. This pattern may have a frequency of raised portions that is half that of elongated raised portions 81 and 84 that extend radially between the squish step 54 and the flat portion 72 of the combustion chamber 60. That is, there may generally be twice as many of raised portions 81, 84 as there are of raised portions 78 as counted in a circumferential progression. The elongated raised portions may be formed in any way. However, an end mill that removes a first swath of material while moving radially inward, and next removes a second swath of material while moving radially outward adjacent to a path of the first swath was utilized to form the radially extending elongated raised portions 81 and 84 in the embodiment illustrated in FIG. 10. The raised portions 78 on the squish step 54 were created by the relative circumferential positions of the swaths and the repeated pattern all the way around a circle forming the squish step 54, squish band 57 and combustion chamber 60. The positions and spacing between adjacent raised portions 78 and elongated raised portions 81, 84 are determined at least in part by the predetermined distances and/or angles between swaths. (For example, if the swaths were set to overlap each other sufficiently, then the raised portions 78, 81, and 84 would be removed.) The raised portion 78 extend axially and will aid in controlling and guiding gases as they are pushed upwardly off of the piston during a compression cycle. These gases may thus be more evenly distributed during pre-combustion in preparation for a more even flame propagation during combustion.

Figure 11:
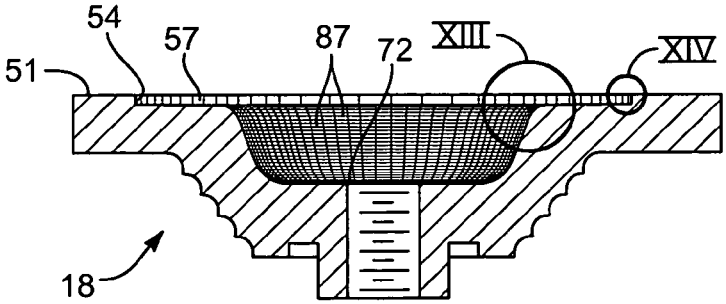
FIG. 11 is a sectional view of the engine head insert taken along line XI-XI of FIG. 10.

FIG. 11 is a sectional view along line XI-XI of FIG. 10 showing the contour in greater detail. The milling machine (not shown) may be operated to adjust the depth of the cuts, such that the contour includes a squish step 54 that is recessed relative to the sealing surface 51. Alternatively, embodiments may include inner surfaces without squish steps or quench areas. The milling machine further controls the end mill to remove material for a moderately inclined surface forming the squish band 54. Alternatively, embodiments include inner surface configurations without squish bands. Referring back to FIG. 11, the radially central portion of the head insert 18 may be formed. The milling machine controls the end mill to form a deep recess forming the combustion chamber 60. The flat region 72 is also formed under the control of the milling machine. Inner surface contours may alternatively include, but are not limited to hemispherical, toroidal, conical, and bathtub shaped configurations. In each of these, the elongated raised portions may be formed by selecting a distance between swaths of an end mill. For example, a range of distances between swaths at the squish step may be from fifty thousandths to two hundred thousandths of an inch. (In the illustrated embodiments of FIGS. 5-11, as the swaths approach the center of the head insert 18, the distance progressively narrows until it reaches zero at the center.) Thus, a texture of elongated raised portions can be formed on the inner surface of an engine head or engine head insert 18. A linear speed of the end mill and the speed of rotation also affect the texture of the inner surface. For example, the small arcuate lines in FIG. 10 (shown as straight lines in FIG. 11) are scallop lines 87 running generally transverse relative to the elongated raised portions 81 and 84. The scallop lines 87 are formed because of the linear speed of the end mill during machining, and their associated structure will be described below. Other processes may also be utilized to achieve similar textures and patterns.

Figure 12:
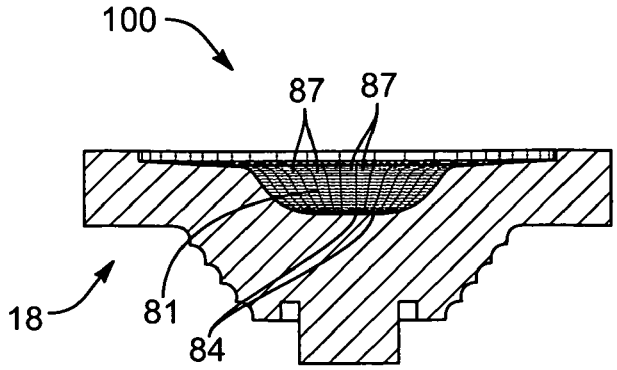
FIG. 12 is a sectional view of the engine head insert of taken along line XII-XII of FIG. 10.

FIG. 12 is a sectional view taken along line XII-XII of FIG. 10. The elongated raised portions 81 and 84 are shown along a sectional edge for emphasis. As shown, the raised portions form channels therebetween that can actually aid in guiding flow of gases during pre-combustion and/or combustion cycles. The scallop lines, which are actually additional elongated raised portions extending generally transversely between the radially extending elongated raised portions 81 and 84, aid in causing turbulence of flow during pre-combustion and/or combustion cycles.

Figure 13:
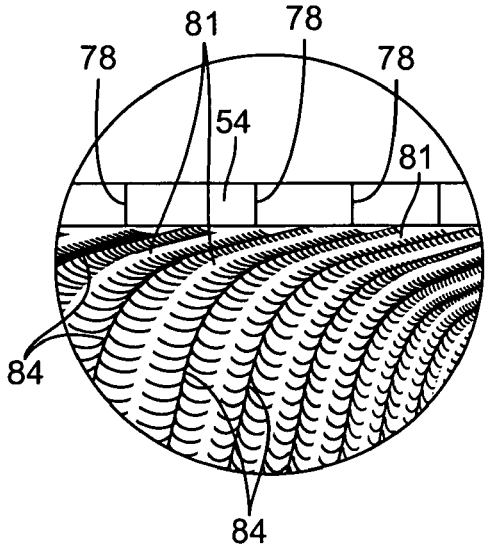
FIG. 13 is a detailed view further illustrating a portion XIII of FIG. 11.

FIG. 13 is a detailed view of a portion XIII of FIG. 10 showing the radially extending elongated raised portions 81 and 84 extending from the squish step 54 and raised portions 78 on the squish step 54. The transversely extending raised portions (or scallop lines) 87 have an arcuate structure that actually forms the apexes of the radially extending elongated raised portions 81 and 84. The height of the apexes depends on the diameter of the end mill being used and the distance between swaths. However, heights of the apexes of the radially extending elongated raised portions 81 and 84 may be in a range from five thousandths to five hundredths of an inch from peak to valley.

Figure 14:
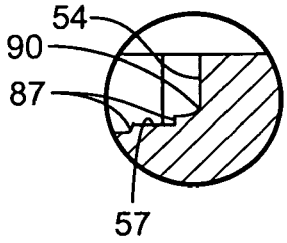
FIG. 14 is a detailed view further illustrating a portion XIV of FIG. 11.

FIG. 14 is a detailed view of a portion labeled XIV in FIG. 10. The transversely extending raised portions or scallop lines 87 may be formed by removal of material on each side of the raised portions 87. A height of the raised portions 87 may be in a range from five thousandths to two hundredths of an inch from peak to valley, for example. In the case where these raised portions are formed by an end mill, the linear speed of the end mill leaves the raised portions between engagement of a portion of each flute of the end mill with the material of the inner surface of the head insert 18. Thus, greater or lesser space may be placed between these raised portions 87 by adjusting the linear speed of the end mill. A linear speed in one of the embodiments was seventy-five feet per minute, and the rotational speed was five thousand RPM.

FIG. 14 also shows how boundaries 90 between the squish step 54 and the squish band 57 are rounded. These rounded boundaries 90 are inherent in milled boundaries and aid in flow of gases during pre-combustion and/or combustions cycles. Other boundaries between other regions are also likewise rounded. In alternative embodiments one or more of these boundaries may be sharp boundaries that are not rounded.

Figure 15A:
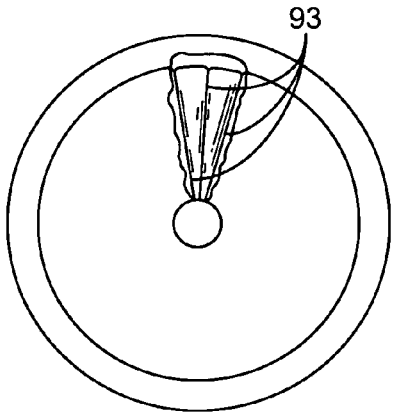
FIGS. 15A-15E are diagrammatic bottom views showing example textures according to alternative embodiments of the invention.

FIGS. 15A-15E show a variety of examples of textures and patterns that may be implemented on an inner surface of engine heads or head inserts 18 without limitation. FIG. 15A show an embodiment in which the transversely extending raised portions are omitted. Radially extending elongated raised portions 93 may be placed along some or all of the squish step, squish band, and combustion chamber of an engine head or head insert 18.

Figure 15B:
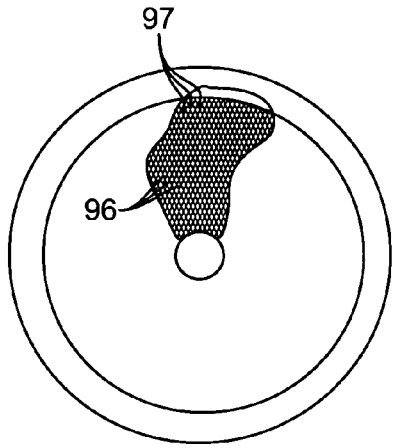

FIG. 15B shows a texture that includes raised portions that extend diagonally relative to a radial direction. These raised portions may include two or more sets 96, 99 of elongated raised portions that extend transverse to each other. Alternatively, a single set of raised portions may extend generally diagonally relative to the radial direction. The texture or pattern of raised portions may extend over all or part of the squish step, squish band, and combustion chamber of an engine head or head insert 18.

Figure 15C:
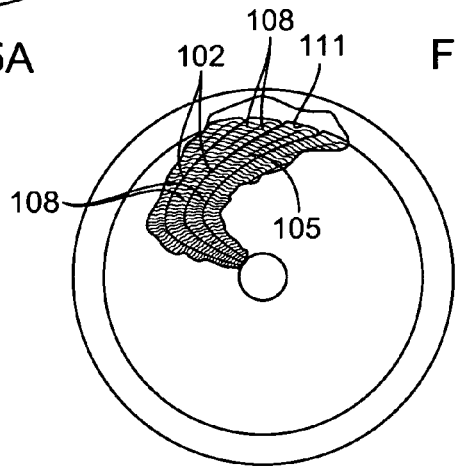

FIG. 15C shows a texture of elongated raised portions 102, 105 and transversely extending raised portions 108 similar to those described with regard to FIGS. 5-14 above. However, the elongated raised portions 102 and 105 do not extend radially from the squish step 111. Rather, the elongated raised portions 102 and 105 extend diagonally for at least a portion of their length and then bend into a more radial alignment for a swirl effect on gases during pre-combustion and/or combustion cycles. The texture may be incorporated onto all or part of the inner surface of one or more of the squish step, squish band, and combustion chamber of an engine head or head insert 18.

Figure 15D:
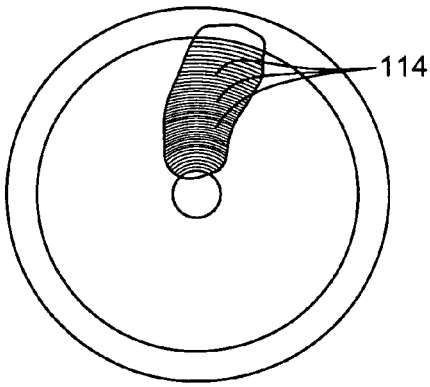

FIG. 15D shows a texture that omits the radially extending elongated raised portions. Rather, transversely extending elongated raised portions 114 are formed in all or part of the surfaces of the squish step, squish band, and the combustion chamber of an engine head or head insert 18.

Figure 15E:
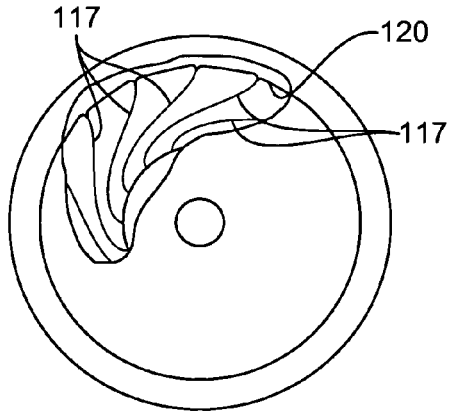

FIG. 15E shows a texture similar to that of FIG. 15C except that elongated raised portions 117 extend generally radially from the squish step 120, then they bend diagonally, and then bend back radially for a swirl effect. These elongated raised portions may be implemented with or without transversely extending raised portions as shown and described with regard to FIGS. 5-14 and 15C. The texture may be implemented on all or part of the squish step, squish band, and combustion chamber of an engine head or head insert 18.

In general, it is to be understood that the elongated raised portions may form a repeating pattern of lengthwise radially extending ribs on the inner surface. Alternatively or additionally, the elongated raised portions may form a repeating pattern of lengthwise generally circumferentially extending ribs on the inner surface. Further alternatively or additionally, the elongated raised portions may form a repeating pattern of lengthwise axially extending ribs on the squish step surface. The elongated raised portions may be spaced at intervals in a range from one one-hundredth to one half inch apart. It is also to be understood that reference herein to raised portions or ribs is a relative term and that indentations, grooves, and scallops may form relative depressions such that a texture is created by the respective high and low points on the surfaces. Furthermore, it is to be understood that while the textures have been shown on the squish step, squish band, and in a portion of the combustion chamber in some of the figures, textures may be extended to greater of fewer portions without limitations. For example, a region immediately surrounding the spark plug hole in FIGS. 6-10 may be textured similar to the textured, sloped portions of the combustion chamber shown. Still further, it is to be understood that the combustion chamber may have any of a variety of configurations including hemispherical, which may not include a squish band. Other configurations include combustion chambers that do not include a squish step, and may or may not include the squish band.

In embodiments of a method in accordance with the present invention, improved performance including one or more of improved efficiency and increased power are achieved by introducing a certain order into the flow and/or combustion of gases within the cylinder and/or combustion chamber. In this regard, elongated raised portions on inner surfaces of engine heads or engine head inserts may help to form streamlets in a flow of pre-combustion and/or combustion gases. The elongated raised portions may help to increase turbulence. Additionally, transversely extending elongated raised portions may additionally or alternatively increase turbulence. Increasing turbulence and order may contribute to a more controlled and directed flame propagation during combustion. Also, added turbulence aids in scavenging residuals from a previous combustion step and may aid in maintaining the fuel in an atomized state during pre-combustion. The result is more complete combustion, lower exhaust gas temperatures, and/or lower emissions out of the exhaust system. The textures and patterns described herein may be utilized to implement an embodiment of the method in which the textures and patterns form a boundary layer during flow of pre-combustion and combustion gases. The boundary layers may thus inhibit condensation of fuel on the inner surface of the engine head or head insert. Additionally, forming the boundary layer may concentrate the combustion more centrally.

The steps described herein are indicative of embodiments of the present method. Other steps and methods may be conceived that are equivalent in function, logic, or effect to one or more steps, or portions thereof, of the present method.

Additionally, the steps of the method and the order of the steps described are to be understood as non-limiting with regard to the scope of the method.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus to improve performance of internal combustion engines, comprising:

an internal combustion engine head, including:

an outer surface and an oppositely facing inner surface adapted for facing an inside of a piston cylinder of an internal combustion engine;

a contour on the inner surface including at least one of a squish step surface, a squish band surface, and a combustion chamber surface; and elongated raised portions extending from the combustion chamber surface to one of the squish step surface or the squish band surface, wherein the elongated raised portions form a repeating pattern.

2. The internal combustion engine head of claim 1, wherein the elongated raised portions comprise a first set of ribs extending longitudinally in a first direction, the inner surface comprising a second set of ribs extending longitudinally in a second direction transverse to the first direction.

3. The internal combustion engine head of claim 2, wherein the first direction is a radial direction and the second direction is a generally circumferential direction.

4. The internal combustion engine head of claim 1, wherein the repeating pattern is formed of lengthwise radially extending ribs on the inner surface.

5. The internal combustion engine head of claim 1, wherein the repeating pattern is formed of lengthwise generally circumferentially extending ribs on the inner surface.

6. The internal combustion engine head of claim 1, wherein the repeating pattern is formed of lengthwise axially extending ribs on the squish step surface.

7. The internal combustion engine head of claim 1, wherein the elongated raised portions are spaced at intervals in a range from one one-hundredth to one half inch apart.

8. The internal combustion engine head of claim 1, wherein:

the inner surface includes a sealing surface at a radially outer extent meeting the contour;

the contour comprises the squish step surface, the squish step surface facing radially inward; and the contour comprises the squish band surface; and the elongated raised portions are on the squish step surface and extend axially generally between the sealing surface and the squish band surface.

9. The internal combustion engine head of claim 8, wherein the elongated raised portions are spaced circumferentially at intervals in a range from one-twentieth to one half inch apart.

10. The internal combustion engine head of claim 1, wherein:

the contour includes at least two of the squish step surface, the squish band surface, and the combustion chamber surface; and a boundary between each of the surfaces is rounded.

11. An internal combustion engine head, comprising:

a sealing surface at a radially outer extent;

a squish band radially inward from the sealing surface;

a combustion chamber surface radially inward from the squish band;

a plug opening radially inward from the squish band; and elongated ridges formed in the combustion chamber surface and extending from the plug opening to the squish band, the elongated ridges forming a repeating pattern.

12. The engine head of claim 11, wherein the elongated ridges further comprise radial ridges extending generally radially.

13. The engine head of claim 12, wherein the elongated ridges further comprise cross-wise ridges extending transverse to the radial ridges.

14. The engine head of claim 13, wherein the cross-wise ridges are in a range of one-twentieth to one-half the width of the radial ridges.

15. The engine head of claim 11, further comprising a squish step between the sealing surface and the squish band, the squish step having a radially inwardly facing surface with circumferentially spaced axial elongated raised portions extending axially from the squish band.

16. The engine head of claim 15, wherein the sealing surface, squish step, squish band, and combustion chamber surface are formed by an end mill such that boundaries between the sealing surface, squish step, squish band, and combustion chamber surface are rounded.

* * * * *